United States Patent [19]

Tottori

[11] Patent Number: 4,888,619

[45] Date of Patent: Dec. 19, 1989

[54] MULTI-COLOR IMAGE FORMING APPARATUS FOR FORMING A LATENT IMAGE PATTERN BY USE OF RESIDUAL TONER REMAINING IN A DEVELOPING DEVICE

[75] Inventor: Takafumi Tottori, Osaka, Japan

[73] Assignee: Minolta Camera Kabushiki Kaisha, Osaka, Japan

[21] Appl. No.: 162,684

[22] Filed: Mar. 1, 1988

[30] Foreign Application Priority Data

Mar. 3, 1987 [JP] Japan ..... 62-47933

[51] Int. Cl.[4] ..... G03G 15/00; G03G 21/00; G03G 15/06; G03G 15/01

[52] U.S. Cl. ..... 355/210; 118/645; 118/657; 355/204; 355/215; 355/245; 355/251; 355/326

[58] Field of Search ..... 355/300, 14 D, 4, 15, 355/14 E, 204, 210, 215, 245, 251, 326; 118/645, 656–658, 652; 15/256.5, 256.52; 430/125

[56] References Cited

U.S. PATENT DOCUMENTS

| | | | |
|---|---|---|---|
| 4,373,800 | 2/1983 | Kamiyama et al. | 118/652 X |
| 4,746,954 | 5/1988 | Matuura et al. | 355/4 X |
| 4,769,675 | 9/1988 | Watanabe . | |

FOREIGN PATENT DOCUMENTS

| | | | |
|---|---|---|---|
| 0120180 | 6/1986 | Japan | 355/15 |
| 0188560 | 8/1986 | Japan | 355/4 |
| 0035377 | 2/1987 | Japan | 355/14 E |
| 0081674 | 4/1987 | Japan | 355/3 DD |

*Primary Examiner*—A. T. Grimley
*Assistant Examiner*—Edward Pipala
*Attorney, Agent, or Firm*—Burns, Doane, Swecker & Mathis

[57] ABSTRACT

A multi-color image forming apparatus including an electrostatic latent image support member, a plurality of developing devices, an image forming device for forming an electrostatic latent image won the support member, a selector for selecting one of the developing devices, a pattern forming device for forming a latent image pattern on the support member separately from the electrostatic latent image in response to selection from an upstream developing device to a downstream developing device in a rotational direction of the support member by the selector and a control device which performs control such that the latent image pattern is located forwardly of the electrostatic latent image in the rotational direction of the support member, whereby after the latent image pattern has been passed through the upstream and downstream developing devices, the electrostatic latent image is developed by the downstream developing device.

5 Claims, 6 Drawing Sheets

MULTI-COLOR IMAGE FORMING APPARATUS FOR FORMING A LATENT IMAGE PATTERN BY USE OF RESIDUAL TONER REMAINING IN A DEVELOPING DEVICE

BACKGROUND OF THE INVENTION

The present invention generally relates to image forming apparatuses and more particularly, to a multi-color image forming apparatus such as a multi-color copying apparatus, a multi-color printer or the like.

Recently, as one type of a multi-color image forming apparatus, there has been provided a multi-color copying apparatus in which a plurality of developing devices containing developers of different colors, respectively are disposed around a photosensitive drum and are driven sequentially such that an image of a desired color is obtained.

However, this known multi-color copying apparatus has the following drawback due to the fact that an electrostatic latent image formed on a surface of the photosensitive drum is passed by fronts of all the developing devices. Namely, when the electrostatic latent image is developed by using a downstream one of the developing devices, the electrostatic latent image is initially brought into contact with the developers of upstream ones of the developing devices if the developers of the respective developing devices are held in contact with the surface of the photosensitive drum, thereby resulting in mixing of the colors.

Conventionally, in order to prevent such a phenomenon, there have been proposed methods that a mechanism for retracting an unused one of the developing devices is provided and that drive of the unused one of the developing devices is stopped. However, in the case where the mechanism for retracting the unused developing device is provided, such problems arise that the unused developing device cannot be positioned accurately, that the developer leaks out of the unused developing device due to an impact force exerted at the time of displacement of the unused developing device and that a construction of the copying apparatus becomes complicated and thus, the assembly steps and the number of the components are increased, thereby resulting in poor production efficiency and high production cost of the copying apparatus. Meanwhile, in the case where drive of the unused developing device is stopped, such an inconvenience is incurred that when drive of the unused developing device is merely stopped, the developer remaining in a portion of the unused developing device, which portion confronts the photosensitive drum, adheres to the electrostatic latent image, thereby resulting in mixing of colors.

SUMMARY OF THE INVENTION

Accordingly, an essential object of the present invention is to provide, with a view to eliminating the above described disadvantages inherent in conventional multi-color image forming apparatuses, a multi-color image forming apparatus in which when a developing device disposed at an upstream side in a direction of rotation of an electrostatic latent image support member has been changed over to a downstream developing device, a latent image pattern is formed in an image nonforming portion of the electrostatic latent image support member such that an image forming portion of the electrostatic latent image support member is developed by the downstream developing device after the latent image pattern has been passed by portions confronting the upstream and downstream developing devices.

Namely, upon changeover from the upstream developing device to the downstream developing device, the latent image pattern formed in the image nonforming portion of the electrostatic latent image support member is passed, prior to development by the downstream developing device, by the portions confronting the upstream and downstream developing devices, so that the developer remaining in a portion of the upstream developing device, which portion confronts the electrostatic latent image support member, is consumed for the latent image pattern. Thus, at the time of development by the downstream developing device thereafter, even if the electrostatic latent image in the image forming portion of the electrostatic latent image support member is passed by the portion confronting the upstream developing device, mixing of colors due to adherence of the developer of the unused developing device to the electrostatic latent image does not take place.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
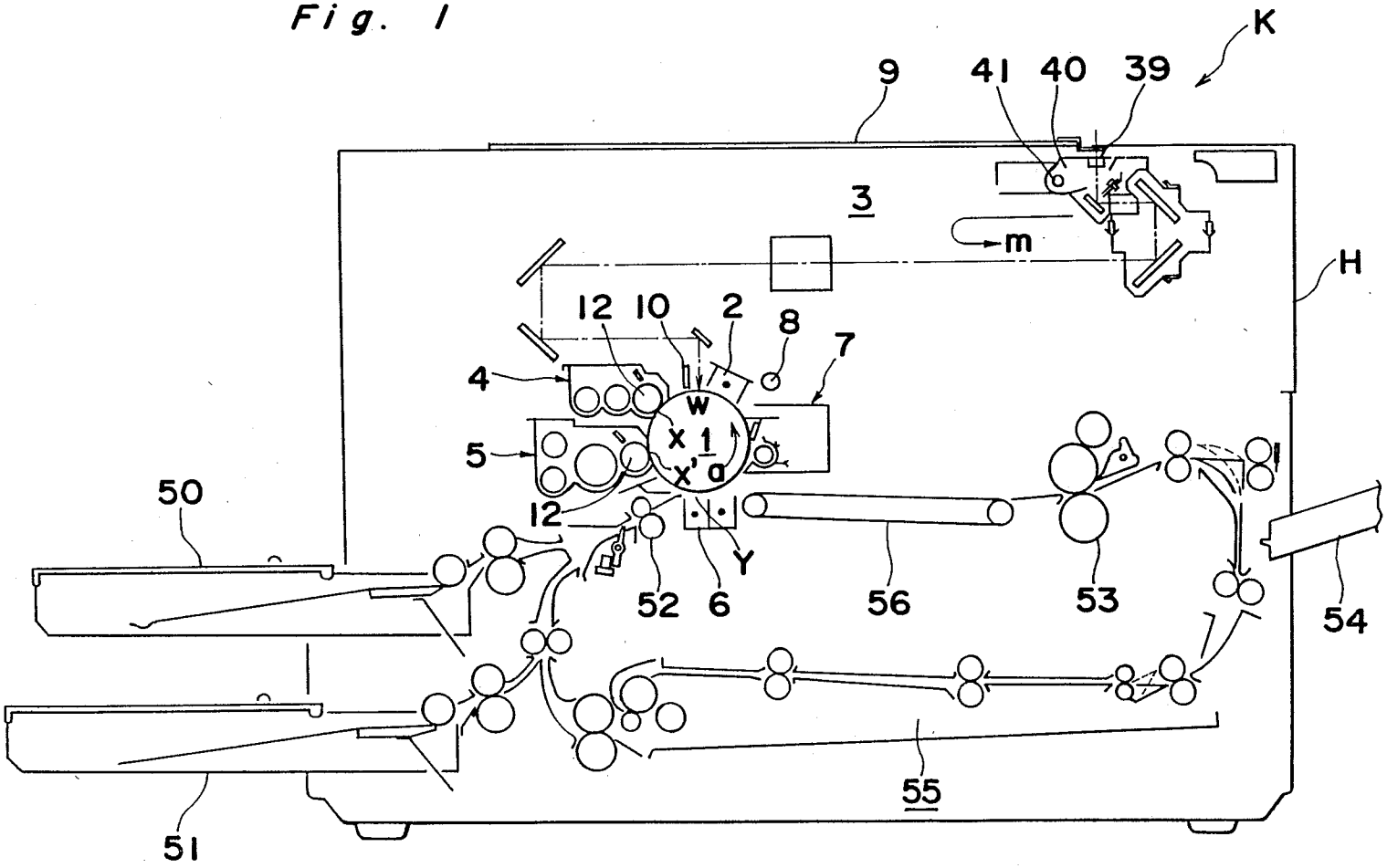
FIG. 1 is a schematic sectional view of a multi-color copying apparatus according to the present invention.

Referring now to the drawings, there is shown in FIG. 1, a multi-color image forming apparatus in the form of a two-color copying apparatus K to which the present invention may be applied. A construction and a standard copying operation of the copying apparatus K are described, hereinbelow. In FIG. 1, the copying apparatus K generally includes a photosensitive or photoreceptor drum 1 rotatably disposed substantially at a central portion of an apparatus housing H for rotation in the direction indicated by the arrow a, and various processing stations such as a corona charger 2, magnetic brush type first and second developing devices 4 and 5, a transfer charger 6, a cleaning device 7, an eraser lamp 8, etc. disposed sequentially in this order around the photosensitive drum 1.

Initially, in a state where the photosensitive drum 1 is rotating in the direction of the arrow a, electric charge is uniformly imparted to a surface of the photosensitive drum 1 through discharge of the corona charger 2.

Meanwhile, a scanner 40 of an optical system 3 scans in the direction of the arrow m an original document (not shown) placed on a transparent original platform 9 made of glass by projecting light from an exposure lamp 41. The reflected light from the original document is projected, at an exposure point W, onto the surface of the photosensitive drum 1 via reflecting mirrors and a lens assembly and thus, an electrostatic latent image corresponding to an image of the original document is formed on an image forming portion of the photosensitive drum 1.

Then, upon light emission of an eraser 10 formed by a plurality of lamps arranged axially in multiple stages such as an LED array, electric charge of an image non-forming portion of the photosensitive drum 1 is erased. Subsequently, at a developing region X or X' of the photosensitive drum 1, which confronts a developing sleeve 12 provided in each of the first and second developing devices 4 and 5, the electrostatic latent image is supplied with toner so as to be developed into a visible toner image which reproduces the image of the original document.

A copy paper sheet is selectively supplied from a paper feeding section 50 or 51 provided at a lower left portion of the apparatus housing H and is transported by two engaged timing rollers 52 to a portion (transfer region Y) of the photosensitive drum 1, which portion confronts the transfer charger 6, synchronously with the toner image formed on the photosensitive drum 1. After the toner image has been transferred onto the copy paper sheet at the transfer region Y, the copy paper sheet is transported by a transport belt 56 in between a pair of fixing rollers 53 where the toner image of the copy paper sheet is fixed on the copy paper sheet by heat fusion of the toner. Then, the copy paper sheet having the toner image fixed thereon is discharged onto a copy receiving portion 54.

However, if a duplex copying mode has been selected, the copy paper sheet is conveyed into a duplex device 55 without being discharged onto the copy receiving portion 54. At the duplex device 55, the copy paper sheet is turned over from its front face to its reverse face and then, is again transported to the transfer region Y. Hence, a second copying operation is performed at the optical system 3 and around the photosensitive drum 1 in the same manner as described above so as to form an image on the reverse face of the copy paper sheet at this time.

Meanwhile, if a composite copying mode has been selected, the copy paper sheet transported to the duplex device 55 is again conveyed as it is, without being turned over from the front face to the reverse face, to the transfer region Y such that a second image is further copied onto the front face.

The toner remaining on the surface of the photosensitive drum 1 is scraped off therefrom by the cleaning device 7 and further, residual toner thereon is erased through irradiation of light by the eraser lamp 8 in preparation for subsequent development.

Meanwhile, in the copying apparatus K of the above described arrangement, if the developer of the second developing device 5 remains in a developing state in the developing region X' when development is performed by using the upstream first developing device 4, the toner image formed by the first developing device 4 is disturbed by the developer of the second developing device 5. On the other hand, merely if a motor M1 (FIG. 9) for driving the first developing device 4 is stopped when development is performed by using the downstream second developing device 5, the toner held on the developing sleeve 12 of the first developing device 4 and remaining in the developing region X is brought into contact with the electrostatic latent image on the photosensitive drum 1, thereby resulting in mixing of colors.

Figure 2:
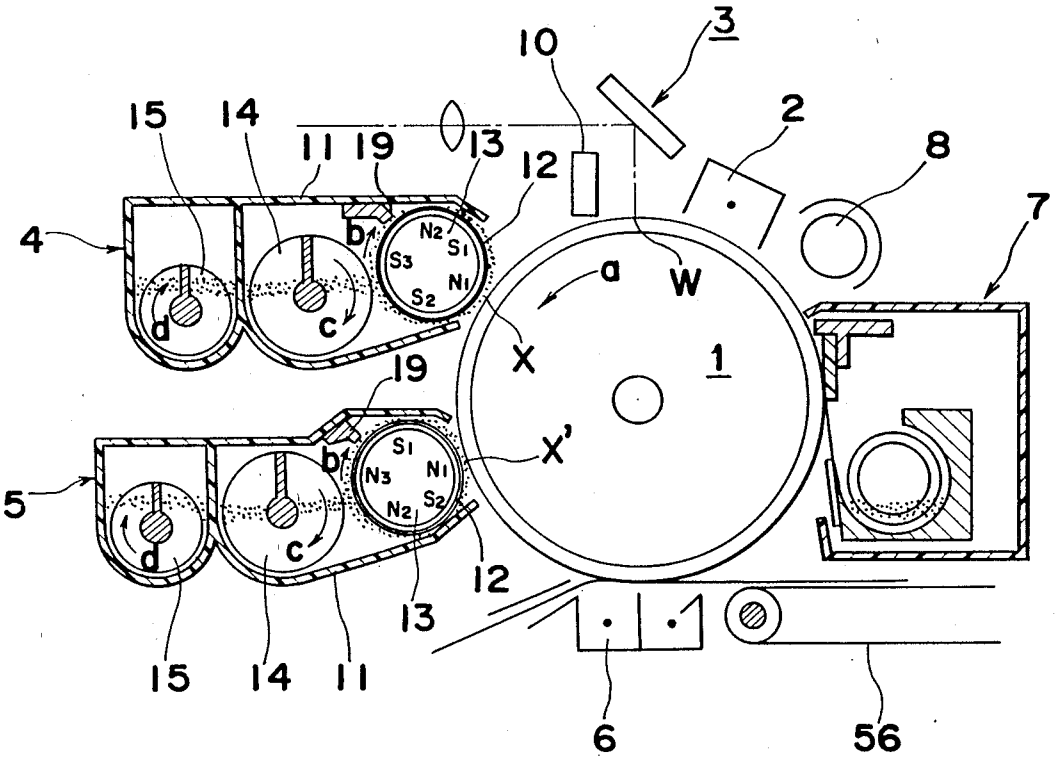
FIG. 2 is a fragmentary sectional view of the multi-color copying apparatus of FIG. 1.
Figure 5:
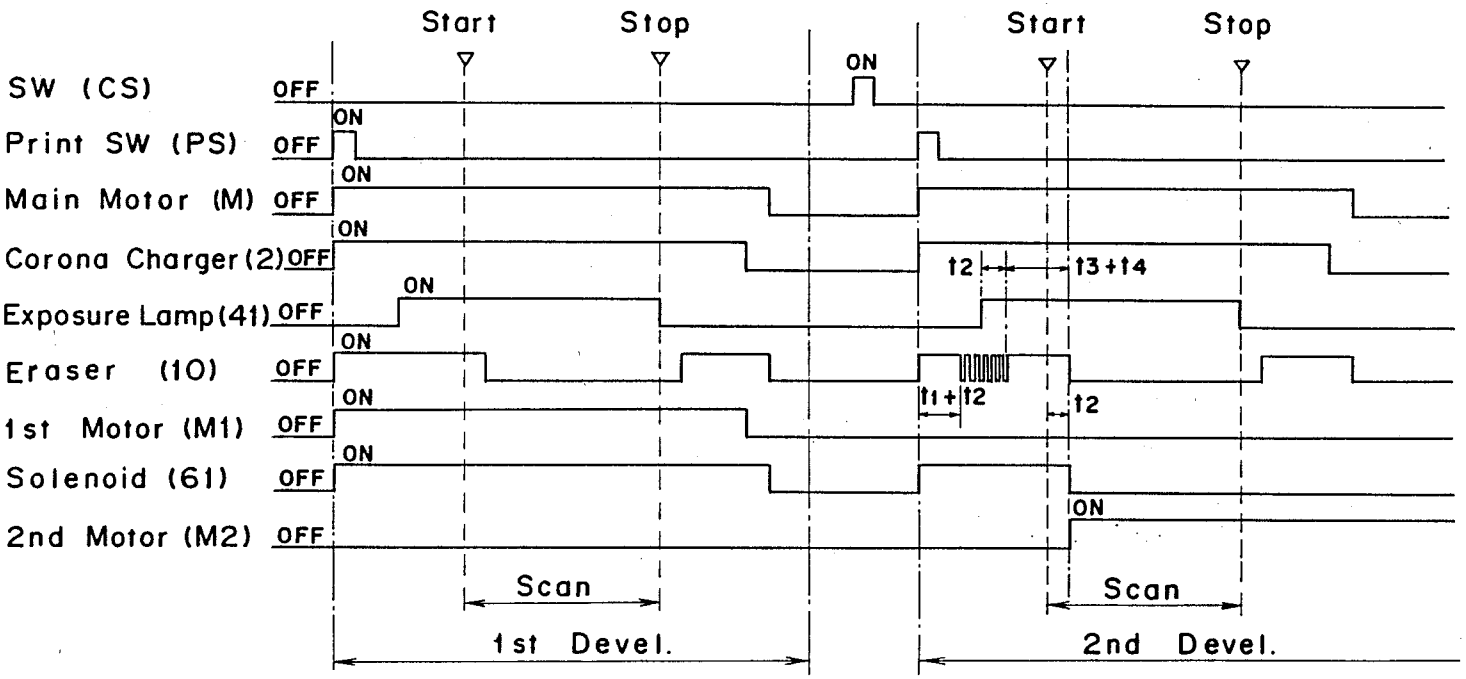
FIG. 5 is a timing chart showing drive control of the multi-color copying apparatus of FIG. 1.

Thus, the first and second developing devices 4 and 5 are arranged as follows and the first and second developing devices 4 and 5, the eraser 10, etc. are controlled in accordance with a timing chart of FIG. 5. Initially, the arrangement of the first and second developing devices 4 and 5 is described. As shown in FIG. 2, the first and second developing devices 4 and 5 are substantially identical with each other in construction. Namely, each of the first and second developing devices 4 and 5 includes a developing tank 11 in which a developing sleeve 12, a supply roller 14 and a screw 15 are rotatably provided sequentially in this order away from the photosensitive drum 1. The first developing device 4 contains a developer composed of magnetic carrier and insulating color toner, while the second developing device 5 contains a developer composed of magnetic carrier and insulating black toner in common use.

Figure 3:
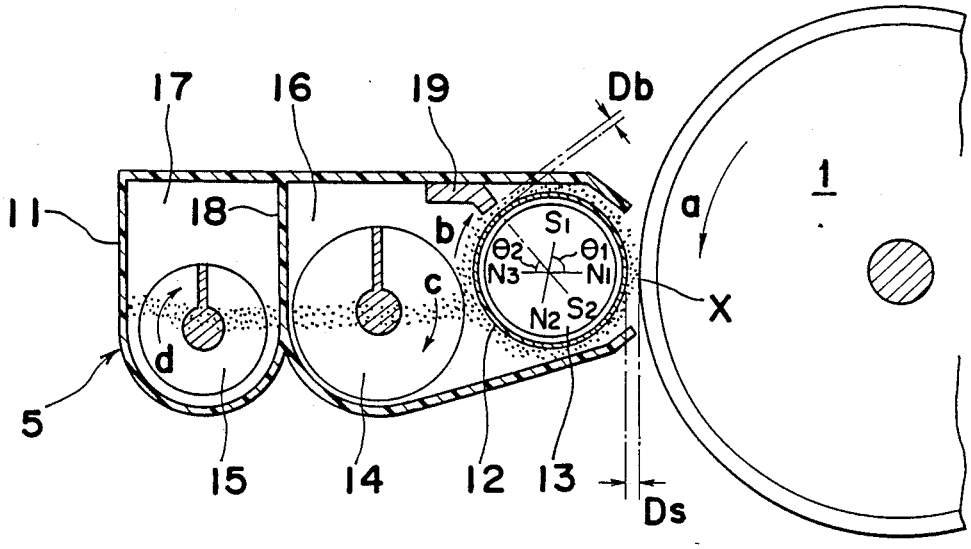
FIGS. 3 and 4 are sectional views of a second developing device employed in the multi-color copying apparatus of FIG. 1.

The developing sleeve 12 is made of non-magnetic electrically conductive material and is formed into a cylindrical shape. The developing sleeve 12 is formed, on its outer peripheral surface, with minute concave and convex portions or uneven portions and confronts the surface of the photosensitive drum 1 at the developing regions X and X' through a developing gap Ds as shown in FIG. 3. The developing sleeve 12 is rotatably provided so as to be rotated in the direction of the arrow b. At a rear side of the developing sleeve 12, i.e. at one side of the developing sleeve 12 remote from the photosensitive drum 1, a distal end of a magnetic brush bristle height regulating member 19 provided on an upper inner face of the developing tank 11 confronts the developing sleeve 12 through a bristle height regulating gap Db as shown in FIG. 3.

Figure 4:
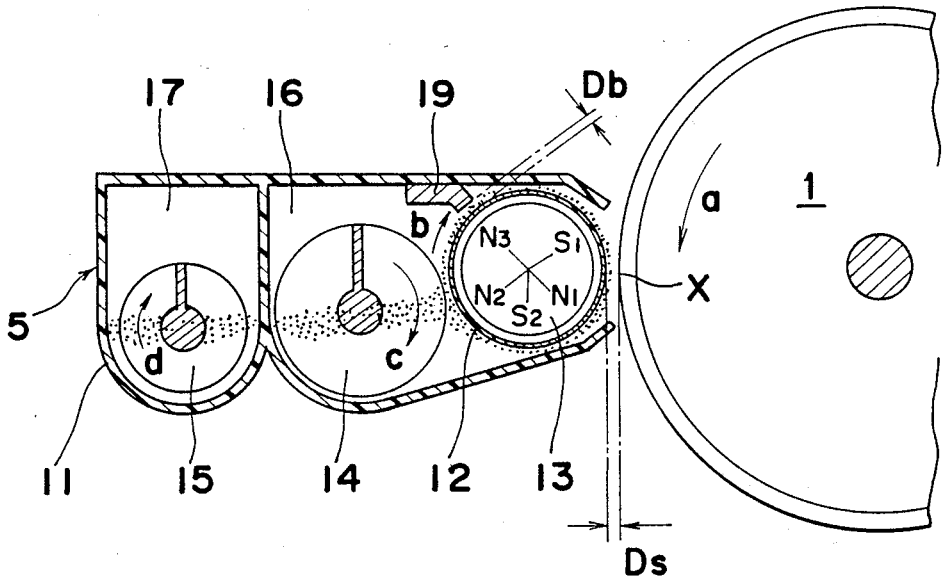

In the developing sleeve 12, a magnet roller 13 having a plurality of axially extending magnets is provided. Magnetic poles N1 to N3 and S1 and S2 disposed at outer peripheral surfaces of these magnets are arranged in the illustrated sequence. The magnet roller 13 of the first developing device 4 is fixed in a state shown in FIG. 3, while the magnet roller 13 of the second developing device 5 can be changed over to the state shown in FIG. 3 and a state shown in FIG. 4 by a solenoid 61 shown in FIG. 9.

In the state shown in FIG. 3, the magnetic pole N1 confronts the photosensitive drum 1 and the center of the magnetic pole N3 is located at a position displaced through an angle 82 counterclockwise from the portion confronting the bristle height regulating member 19. Meanwhile, in the state shown in FIG. 4, the center of the magnetic pole N3 is so located as to confront the bristle height regulating member 19 and an intermediate portion between the magnetic poles S1 and N1 forming therebetween an angle $\theta 1$ set at a value twice the angle $\theta 2$ confronts the photosensitive drum 1.

The supply roller 14 and the screw 15 are, respectively, disposed in transport passages 16 and 17 separated from each other in the developing tank 11 by a partition wall 18 and are rotatably provided so as to be rotated in the directions of the arrows c and d by motors M1 and M2 (FIG. 9) in the first and second developing devices 4 and 5, respectively. The transport passages 16 and 17 are communicated with each other through openings (not shown) formed on the partition wall 18, which openings are disposed at front and rear portions of the partition wall 18 in the direction perpendicular to the drawing sheet of FIG. 3.

Figure 6:
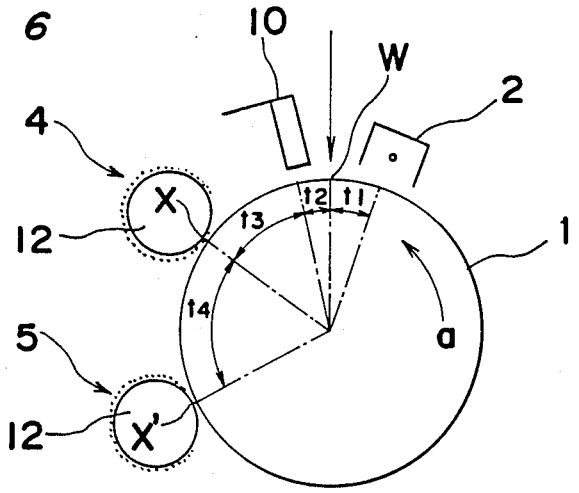
FIG. 6 is view explanatory of time periods required for travel of a point on a photosensitive drum employed in the multi-color copying apparatus of FIG. 1.
Figure 9:
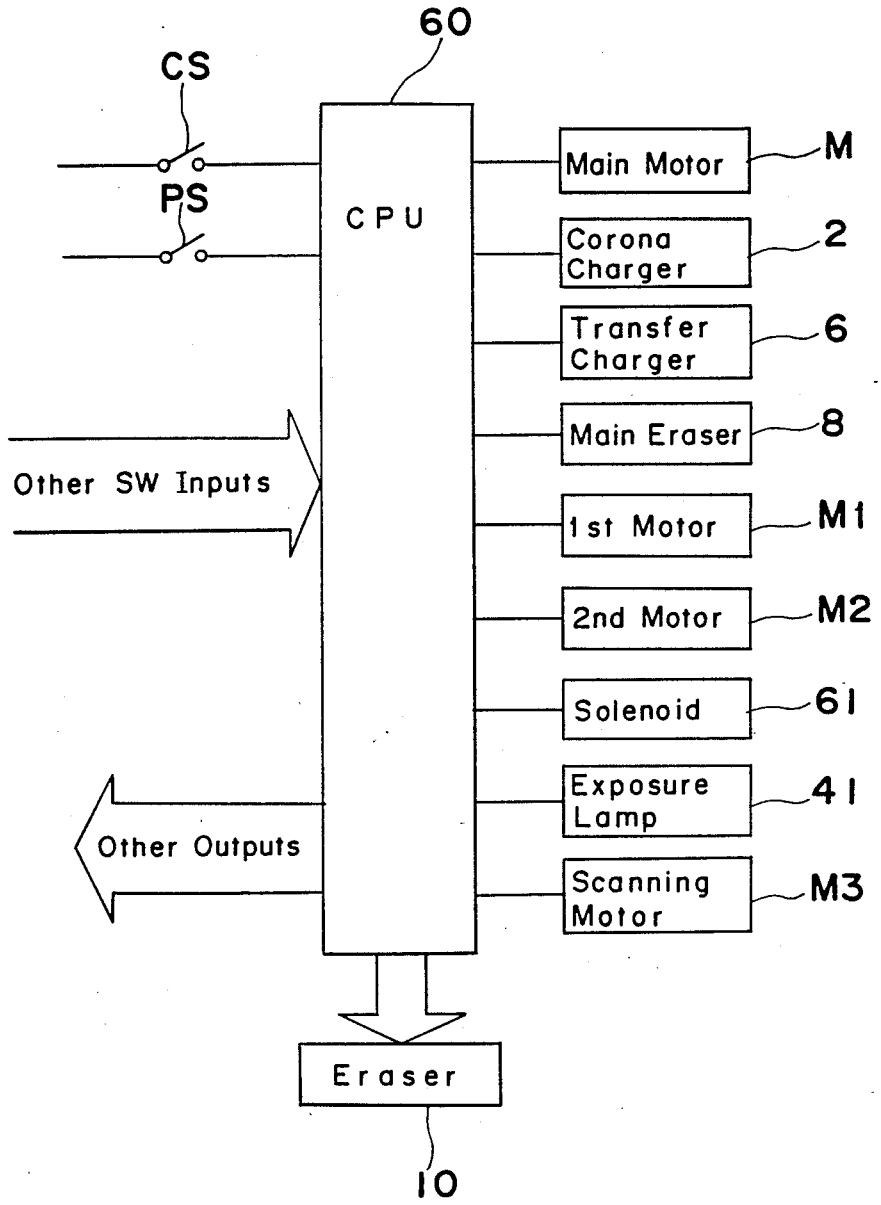
FIG. 9 is an electrical block diagram of the multi-color copying apparatus of FIG. 1.

Hereinbelow, control of the first and second developing devices 4 and 5, the eraser 10, etc. is described with reference to the timing chart of FIG. 5. As shown in FIG. 6, it is to be noted that characters t1, t2, t3 and t4 denote time periods required for a point on the outer peripheral surface of the photosensitive drum 1 to proceed from the portion confronting the corona charger 2 to the exposure point W, from the exposure point W to the portion confronting the eraser 10, from the portion confronting the eraser 10 to the developing region X and from the developing region X to the developing region X', respectively. Furthermore, it should be noted as shown in FIG. 9 that a main motor M for driving the photosensitive drum 1, the corona charger 2, the transfer charger 6, the eraser lamp 8, the motor M1 for driving the first developing device 4, the motor M2 for driving the second developing device 5, the solenoid 61 for the second developing device 5, the exposure lamp 41, a scanning motor M3, the eraser 10, a changeover switch CS and a print switch PS are connected to a central processing unit (CPU) 60 and various input signals are applied from other switches of the copying apparatus K to the CPU 60 such that the CPU 60 delivers various output signals to other elements of the copying apparatus K. In the case where a colored copy is obtained by using the upstream first developing device 4, the main motor M of the photosensitive drum 1, the corona charger 2, the eraser 10 and the motor M1 of the first developing device 4 are turned on in accordance with the standard copying operation in response to turning on of the print switch PS, while in the second developing device 5, the solenoid 61 is turned on so as to set the magnet roller 13 to the state shown in FIG. 4.

Subsequently, upon lapse of a predetermined time period, the exposure lamp 41 is turned on and then, the scanner 40 performs a scanning operation in the direction of the arrow m of FIG. 1 such that the electrostatic latent image is formed in the image forming portion of the photosensitive drum 1. In the first developing device 4, while the developer is being circulated through the transport passages 16 and 17 by the supply roller 14 and the screw 15, a portion of the developer is supplied to the surface of the developing sleeve 12. The developer supplied to the surface of the developing sleeve 12 is transported in a state of a magnetic brush in the direction of the arrow b such that a transport amount of the developer is regulated when the developer passes through the portion confronting the bristle height regulating member 19. The developer conveyed to the developing region X is held in an erect state along lines of magnetic force of the magnetic pole N1 and is brought into contact with the electrostatic latent image on the surface of the photosensitive drum 1 at the developing region X so as to supply the color toner to the electrostatic latent image into a visible toner image.

On the other hand, in the second developing device 5, the solenoid 61 is turned on such that the intermediate portion between the magnetic poles S1 and N1 confronts the developing region X'. At the intermediate portion between the magnetic poles S1 and N1, the magnetic brush is in a state directed tangentially to the surface of the developing sleeve 12 and thus, the black toner is held out of contact with the surface of the photosensitive drum 1. Therefore, even if the image formed by the color toner at the first developing device 4 is passed through the developing region X' of the second developing device 5, the image formed by the color toner at the first developing device 4 is not disturbed by the magnetic brush of the black toner.

Then, when the changeover switch CS is turned on so as to change over the developing mode from the color copying mode to the black copying mode and then, the print switch PS is turned on, the main motor M, the corona charger 2, the eraser 10 and the solenoid 61 of the second developing device 5 are initially turned on.

Figure 7:
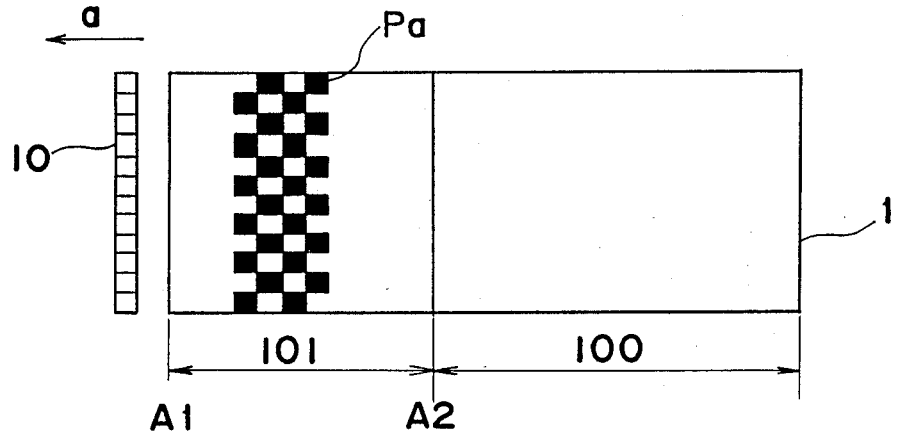
FIGS. 7 and 8 are development views of the photosensitive drum of FIG. 6.

As shown in FIG. 7 which is a development view of the photosensitive drum 1, after a time period of (t1+t2) from turning on of the print switch PS, a start point A1 of an image nonforming portion 101 of the photosensitive drum 1 reaches the portion confronting the eraser 10 where a plurality of the lamps arranged axially in multiple stages are turned on and off alternately, so that a checked latent image pattern Pa is formed in the image nonforming portion 101. Subsequently, when the exposure lamp 41 is turned on so as to project light onto an image forming portion 100 of the photosensitive drum 1 and after a time period of t2 from turning on of the exposure lamp 41, a start point of the image forming portion 100, which coincides with an end point A2 of the image nonforming portion 101, reaches the portion confronting the eraser 10, all the lamps of the eraser 10 are reinstated to the ON state and thus, formation of the latent image pattern Pa in the image nonforming portion 101 is completed.

Subsequently, after a time period of (t3+t4) from turning on of the exposure lamp 41, the scanner 40 starts a scanning operation in the direction of the arrow m and further, after a time period of t2 from that time, namely, when the end point A2 of the image nonforming portion 101 has been passed through the developing region X', the motor M2 of the second developing device 5 is turned on and the eraser 10 and the solenoid S of the second developing device 5 are turned off such that the second developing device 5 is set to a state enabling development, so that development of the electrostatic latent image formed in the image forming portion 100 is started by the second developing device 5.

Thus, prior to start of development of the electrostatic latent image in the image forming portion 100 by the second developing device 5, the latent image pattern Pa is passed through the developing region X so as to remove the color toner present in the developing region X. Therefore, even if the electrostatic latent image in the image forming portion 100 is passed through the developing region X thereafter, such a probability is slim that mixing of colors due to supply of the color toner to the electrostatic latent image of the image forming portion 100 takes place.

Furthermore, in this embodiment, since the latent image pattern Pa is of a checked form having a number of edge portions enabling adherence of a large quantity of the toner thereto such that the edge portions are passed through the developing region X as frequently as possible, almost all the color toner is removed from the developing region X efficiently, thereby further reducing occurrence of mixing of colors.

Figure 8:
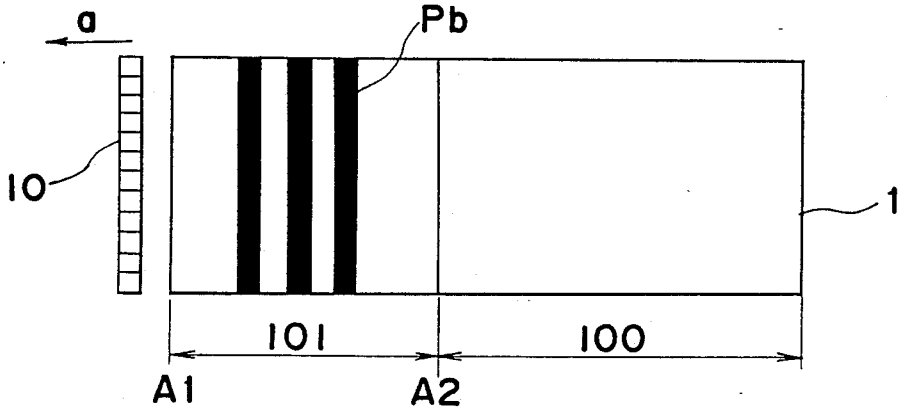

Meanwhile, in the above described embodiment, the electrostatic latent image pattern Pa has a checked form but is not restricted thereto. Namely, it may be possible to employ an electrostatic latent image pattern Pb of a striped form as shown in FIG. 8.

Meanwhile, in the above described embodiment, during one rotation of the photosensitive drum 1, the latent image pattern Pa is formed in the image nonforming portion 101 so as to consume the color toner in the developing region X and further, the developing operation of the electrostatic latent image of the image forming portion is performed. However, it can also be so arranged that the toner in the developing region X is initially removed during one rotation of the photosensitive drum 1 and then, the developing operation of the electrostatic latent image is started from the next rotation of the photosensitive drum 1.

Furthermore, in the above described embodiment, the eraser 10 is set to the ON state prior to and after formation of the latent image pattern through repeated turning on and off of the eraser 10. However, it can also be so arranged that the eraser 10 is set to the OFF state prior to and after formation of the latent image pattern.

Moreover, in the above described embodiment, the two-component developer composed of toner and carrier is employed. However, it is needless to say that the present invention is applicable to a copying apparatus provided with a developing device employing a one-component developer.

As is clear from the foregoing description, in the multi-color image forming apparatus according to the present invention, the latent image pattern is formed in the image nonforming portion after changeover from the upstream developing device to the downstream developing device such that the developing operation of the electrostatic latent image in the image forming is started after the latent image pattern has been passed through the portions confronting the upstream and downstream developing devices.

Accordingly, in accordance with the present invention, since the developer remaining in the developing region of the upstream developing device is consumed through its adherence to the latent image pattern prior to start of development of the electrostatic latent image of the image forming portion, a vivid image free from mixing of colors can be obtained through elimination of supply of toners of different colors to the electrostatic latent image of the image forming portion.

Furthermore, in accordance with the present invention, the multi-color image forming apparatus does not require a complicated structure, the multi-color image forming apparatus can be produced efficiently and at low cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A multi-color image forming apparatus comprising:

a support member for supporting an electrostatic latent image to be copied, which is rotatably provided so as to be rotated in one direction;

a plurality of developing means which are provided around said support member and contain developers having different colors, respectively;

an image forming means for forming the electrostatic latent image on said support member;

a selector means for selecting one of said developing means;

a pattern forming means which forms a latent image pattern in an image nonforming portion of said support member separately from the electrostatic latent image when selection from an upstream one of said developing means to a downstream one of said developing means in the one direction of rotation of said support member has been effected by said selector means; and a control means which performs control such that the latent image pattern is so formed on said support member by said pattern forming means as to be located forwardly of the electrostatic latent image as observed in the one direction of rotation of said support member, whereby after the latent image pattern has been passed through the upstream one and the downstream one of said developing means, the electrostatic latent image is developed by the downstream one of said developing means.

2. A multi-color image forming apparatus comprising:

a photoreceptor which is rotatably supported so as to be rotated in one direction;

an electric charging means for electrically charging said photoreceptor uniformly;

an image forming means which exposes an image on said photoreceptor subjected to electric charging of said electric charging means so as to form an electrostatic latent image on said photoreceptor;

a pattern forming means for forming a predetermined latent image pattern on said photoreceptor subjected to electric charging of said electric charging means;

a first developing means for developing the electrostatic latent image by using a first color, which is so provided as to confront said photoreceptor;

a second developing means for developing the electrostatic latent image by using a second color, which is so provided as to be located downstream of said first developing means in the one direction of rotation of said photoreceptor;

a selector means for selecting said first and second developing means; and a control means which, when said second developing means has been selected by said selector means, causes said image forming means and said pattern forming means to form the electrostatic latent image and the latent image pattern on said photoreceptor, respectively such that the latent image pattern is located forwardly of the electrostatic latent image in the one direction of rotation of said photoreceptor, whereby after the latent image pattern has been passed through said first and second developing means, the electrostatic latent image is developed by said second developing means.

3. A multi-color image forming apparatus as claimed in claim 2, wherein when said first developing means has been selected by said selector means, said pattern forming means is kept inoperative.

4. A multi-color image forming apparatus as claimed in claim 2, wherein said pattern forming means includes a plurality of lamps arranged linearly and the latent image pattern is formed by selectively energizing said lamps.

5. A multi-color image forming apparatus comprising:

a photoreceptor which is rotatably supported so as to be rotated in one direction;

an electric charging means for electrically charging said photoreceptor uniformly;

an image forming means which exposes an image on said photoreceptor subjected to electric charging of said electric charging means so as to form an electrostatic latent image on said photoreceptor;

a pattern forming means for forming a predetermined latent image pattern on said photoreceptor subjected to electric charging of said electric charging means;

a first magnetic brush developing means for developing the electrostatic latent image with a developer of first color, said developing means including a cylindrical sleeve with a magnet therein for forming magnetic brush on the sleeve;

a second magnetic brush developing means for developing the electrostatic latent image with a developer of second color, said developing means including a cylindrical sleeve with a rotatable magnet therein;

a selector means for selecting said first and second developing means wherein when said first developing means is selected, the magnet of said second developing means is rotated to displace a magnetic pole from facing the photoreceptor; and a control means which, when said second developing means has been selected by said selector means, causes said image forming means and said pattern forming means to form the electrostatic latent image and the latent image pattern on said photoreceptor, respectively such that the latent image pattern is located forwardly of the electrostatic latent image in the one direction of rotation of said photoreceptor, and that the magnetic pole of the magnet of said second developing means faces the photoreceptor to form the magnetic brush on the sleeve for development, whereby after the latent image pattern has been passed through said first and second developing means, the electrostatic latent image is developed by said second developing means.

* * * * *